US011793713B2

(12) United States Patent
Vierheller et al.

(10) Patent No.: US 11,793,713 B2
(45) Date of Patent: Oct. 24, 2023

(54) PERCUSSION MASSAGER HAVING VARIABLE AND SELECTABLE STROKE LENGTH

(71) Applicant: PlayMakar Inc., Fort Worth, TX (US)

(72) Inventors: Federico G. Vierheller, Fort Worth, TX (US); Michael J. Williams, Colleyville, TX (US); Wesley A. Coleman, N. Richland Hills, TX (US)

(73) Assignee: PlayMakar, Inc., Fort Worth, TX (US)

( * ) Notice: Subject to any disclaimer, the term of this patent is extended or adjusted under 35 U.S.C. 154(b) by 0 days.

(21) Appl. No.: 17/524,732

(22) Filed: Nov. 11, 2021

(65) Prior Publication Data

US 2022/0168177 A1 Jun. 2, 2022

Related U.S. Application Data

(60) Provisional application No. 63/164,278, filed on Mar. 22, 2021, provisional application No. 63/120,502, filed on Dec. 2, 2020.

(51) Int. Cl.

| | |
|---|---|
| ***A61H 23/00*** | (2006.01) |
| ***A61H 15/00*** | (2006.01) |
| ***A61H 23/02*** | (2006.01) |

(52) U.S. Cl.

CPC ..... *A61H 23/006* (2013.01); *A61H 15/0085* (2013.01); *A61H 23/0263* (2013.01);

(Continued)

(58) Field of Classification Search

CPC ..... A61H 23/006; A61H 23/0263; A61H 2201/0153; A61H 2201/1215;

(Continued)

(56) References Cited

U.S. PATENT DOCUMENTS 859,424 A * 7/1907 Aschburner ..... A61H 31/008 601/97

890,822 A 6/1908 Tourtel et al.

(Continued)

FOREIGN PATENT DOCUMENTS

CH 388531 A 2/1965
CN 212749648 U 3/1921

(Continued)

OTHER PUBLICATIONS

English translation for KR 102249761, translated by espacenet.com, translated on Oct. 31, 2022.*

(Continued)

*Primary Examiner* — Tu A Vo

(74) *Attorney, Agent, or Firm* — Dawn-Marie Bey; Bey & Cotropia PLLC

(57) ABSTRACT

An adjustable stroke length percussion massage device includes a stroke arm connected to a piston which is connected to a massage tool for providing a massage to a user. The stroke arm is secured to a crank pin of a crank mechanism which includes a rotatably connected crank housing and crank base, the crank pin being movably secured between the crank housing and crank base such that the crank pin moves from a first end to a second end of a sliding groove located in the cam housing when a rotation direction of the single unit is reversed by a motor. When the crank pin is moved from the first end to the second end of the sliding groove, a stroke length of the piston is changed.

14 Claims, 13 Drawing Sheets

(52) U.S. Cl.
CPC ..... *A61H 2015/0028* (2013.01); *A61H 2201/0153* (2013.01); *A61H 2201/123* (2013.01); *A61H 2201/1215* (2013.01); *A61H 2201/1669* (2013.01); *A61H 2201/1671* (2013.01); *A61H 2201/1685* (2013.01); *A61H 2201/1695* (2013.01)

(58) Field of Classification Search
CPC .... A61H 2201/1669; A61H 2201/1671; A61H 2201/149; Y10T 74/18056
See application file for complete search history.

(56) References Cited

U.S. PATENT DOCUMENTS 1,368,782 A * 2/1921 Beach ..... A61H 23/0254 601/93
2,122,556 A 7/1938 Buffalow
2,156,839 A 5/1939 Buffalow
4,088,128 A 5/1978 Mabuchi
4,513,737 A 4/1985 Mabuchi
4,549,535 A 10/1985 Wing
D284,553 S 7/1986 Collister
4,726,369 A 2/1988 Mar
4,726,430 A 2/1988 Hendrikx et al.
4,790,296 A 12/1988 Segal
4,841,955 A 6/1989 Evans et al.
5,085,207 A 2/1992 Fiore
5,134,777 A * 8/1992 Meyer ..... B23D 49/167 30/392
D373,571 S 9/1996 Zambelli
5,656,017 A 8/1997 Keller et al.
5,690,608 A 11/1997 Watanabe et al.
5,697,268 A 12/1997 Makovsky
5,730,044 A 3/1998 Oh
D434,291 S 11/2000 Kim
6,228,042 B1 5/2001 Dungan
6,357,125 B1 * 3/2002 Feldmann ..... B23D 51/16 30/277.4
6,616,621 B1 9/2003 Kohr
6,682,496 B1 1/2004 Pivaroff
6,758,826 B2 7/2004 Luettgen et al.
D525,115 S 7/2006 Harwanko
7,122,013 B2 10/2006 Liu
7,144,417 B2 * 12/2006 Colloca ..... H01F 7/18 601/111
D544,102 S 6/2007 Pivaroff
D578,080 S 10/2008 Whang
7,503,923 B2 * 3/2009 Miller ..... A61H 1/008 173/90
D607,852 S 1/2010 Riede
D631,073 S 1/2011 Papa
D632,265 S 2/2011 Choi
D639,784 S 6/2011 Murayama
D649,657 S 11/2011 Petersen et al.
8,083,699 B2 * 12/2011 Colloca ..... A61H 23/0218 606/237
D662,398 S 6/2012 Jahnke
D679,576 S 4/2013 Paul
8,826,547 B2 9/2014 Oberheim
8,968,221 B2 3/2015 Pryor et al.
D738,355 S 9/2015 Smith
D751,538 S 3/2016 Koehler
D756,333 S 5/2016 Smith
9,526,671 B2 12/2016 Weck et al.
D781,674 S 3/2017 Bullard
9,889,066 B2 2/2018 Danby et al.
D826,205 S 8/2018 Langhammer
D837,395 S 1/2019 Gan
D840,355 S 2/2019 Simon
D848,398 S 5/2019 Huang
D849,260 S 5/2019 Wersland
D850,639 S 6/2019 Wersland
D850,640 S 6/2019 Wersland
10,314,762 B1 * 6/2019 Marton ..... A61H 23/006
10,357,425 B2 7/2019 Wersland et al.
D855,822 S 8/2019 Marton
D857,650 S 8/2019 Hardi
D859,680 S 9/2019 Wersland
D867,342 S 11/2019 Afshar Bakooshli
10,485,731 B2 11/2019 Babiuk
10,492,984 B2 12/2019 Marton et al.
D873,432 S 1/2020 Duan
D874,015 S 1/2020 Marton
10,561,574 B1 2/2020 Marton et al.
D882,785 S 4/2020 Qun
D886,317 S 6/2020 Marton
D890,353 S 7/2020 Nazarian
D890,942 S 7/2020 Wersland
D890,943 S 7/2020 Wersland
10,702,448 B2 7/2020 Wersland et al.
D893,738 S 8/2020 Zhuang
D895,133 S 9/2020 Xu
D895,135 S 9/2020 Xu
D895,402 S 9/2020 Hung
D895,828 S 9/2020 Marshall
D895,831 S 9/2020 Chen
D896,393 S 9/2020 Wersland
D898,933 S 10/2020 Xu
D905,863 S 12/2020 Lin
D906,533 S 12/2020 Xu
D907,792 S 1/2021 Marton et al.
D908,235 S 1/2021 Marton et al.
D910,870 S 2/2021 Marton
D917,060 S 4/2021 Hu
D918,404 S 5/2021 Wersland
D918,405 S 5/2021 Wersland
D918,408 S 5/2021 Huang
10,993,874 B1 5/2021 Marton et al.
D920,944 S 6/2021 Paterson
D924,422 S 7/2021 Huang
D927,716 S 8/2021 Wersland
D927,717 S 8/2021 Wersland
D931,492 S 9/2021 Li
D935,403 S 11/2021 Wu
D935,404 S 11/2021 Wu
D938,056 S 12/2021 Wu
D940,892 S 1/2022 Shen
D941,145 S 1/2022 Wang
11,253,423 B1 2/2022 Williams
D949,365 S 4/2022 Li
D949,366 S 4/2022 Li
D949,384 S 4/2022 Liang
D949,417 S 4/2022 Khubani
D949,418 S 4/2022 Khubani
D952,878 S 5/2022 Lin
D958,654 S 7/2022 Lupberger
D959,268 S 8/2022 Hume
D961,107 S 8/2022 Tian
D961,795 S 8/2022 Zhao
11,452,665 B1 9/2022 Yu
D967,971 S 10/2022 Jinfeng
11,478,400 B1 * 10/2022 Marton ..... A61H 23/0254
11,497,674 B2 * 11/2022 Cheng ..... A61H 1/00
11,497,676 B2 11/2022 Liu
2002/0082532 A1 * 6/2002 Tucek ..... A61H 23/0254 601/107
2002/0107459 A1 8/2002 Chang
2003/0009116 A1 1/2003 Luettgen et al.
2003/0009118 A1 1/2003 Sabo
2003/0028134 A1 * 2/2003 Lev ..... A61H 23/0263 601/111
2003/0040689 A1 2/2003 Chan et al.
2003/0101847 A1 6/2003 Harimoto
2003/0195443 A1 * 10/2003 Miller ..... A61H 23/02 601/108
2005/0109137 A1 * 5/2005 Hartmann ..... B23D 51/16 74/25
2005/0113870 A1 5/2005 Miller
2005/0131461 A1 * 6/2005 Tucek ..... A61H 1/008 601/108
2006/0025710 A1 2/2006 Schulz et al.
2006/0293711 A1 12/2006 Keller et al.
2008/0014011 A1 1/2008 Rossen

(56) References Cited

U.S. PATENT DOCUMENTS

| | | | | |
|---|---|---|---|---|
| 2008/0183252 | A1 | 7/2008 | Khen | |
| 2009/0270915 | A1 | 10/2009 | Tsai et al. | |
| 2010/0137907 | A1 | 6/2010 | Tsai | |
| 2011/0056339 | A1 | 3/2011 | Su | |
| 2014/0031866 | A1 | 1/2014 | Fuhr et al. | |
| 2014/0234146 | A1 | 8/2014 | Pattakos | |
| 2015/0005682 | A1 | 1/2015 | Danby et al. | |
| 2015/0107383 | A1 | 4/2015 | Duesselberg et al. | |
| 2015/0182415 | A1 | 7/2015 | Olkowski et al. | |
| 2016/0354277 | A1 | 12/2016 | Fima | |
| 2016/0367425 | A1* | 12/2016 | Wersland | A61H 1/008 |
| 2017/0001290 | A1 | 1/2017 | Liu | |
| 2017/0304145 | A1* | 10/2017 | Pepe | A61H 23/02 |
| 2018/0008512 | A1 | 1/2018 | Goldstein | |
| 2018/0168913 | A1 | 6/2018 | Sedic | |
| 2018/0200141 | A1 | 7/2018 | Wersland et al. | |
| 2018/0263845 | A1 | 9/2018 | Wersland et al. | |
| 2018/0320732 | A1 | 11/2018 | Kim | |
| 2018/0353369 | A1 | 12/2018 | Newns et al. | |
| 2019/0015294 | A1* | 1/2019 | Nazarian | A61H 15/00 |
| 2019/0175434 | A1* | 6/2019 | Zhang | A61H 15/0085 |
| 2019/0209424 | A1 | 7/2019 | Wersland et al. | |
| 2019/0232403 | A1 | 8/2019 | Candelaria | |
| 2019/0254921 | A1* | 8/2019 | Marton | A61H 23/006 |
| 2019/0350793 | A1* | 11/2019 | Wersland | A61H 23/006 |
| 2019/0365598 | A1 | 12/2019 | Qu | |
| 2020/0046598 | A1 | 2/2020 | Shen | |
| 2020/0046604 | A1 | 2/2020 | Danby et al. | |
| 2020/0085675 | A1* | 3/2020 | Lee | A61H 23/006 |
| 2020/0110526 | A1 | 4/2020 | Ano et al. | |
| 2020/0170871 | A1 | 6/2020 | Lukinuk et al. | |
| 2020/0214930 | A1 | 7/2020 | Wersland et al. | |
| 2020/0261307 | A1 | 8/2020 | Wersland et al. | |
| 2020/0261310 | A1 | 8/2020 | Wersland et al. | |
| 2020/0268594 | A1 | 8/2020 | Pepe | |
| 2020/0276079 | A1 | 9/2020 | Cheng | |
| 2020/0289365 | A1 | 9/2020 | Wersland et al. | |
| 2020/0330321 | A1 | 10/2020 | Wersland et al. | |
| 2020/0352820 | A1 | 11/2020 | Nazarian et al. | |
| 2020/0352821 | A1 | 11/2020 | Wersland et al. | |
| 2020/0390644 | A1* | 12/2020 | Yang | A61H 23/006 |
| 2020/0393026 | A1* | 12/2020 | Chang | A61H 23/006 |
| 2020/0405574 | A1 | 12/2020 | Wersland et al. | |
| 2021/0003168 | A1 | 1/2021 | Cong | |
| 2021/0022951 | A1 | 1/2021 | Hu | |
| 2021/0022955 | A1* | 1/2021 | Wersland | A61B 5/7267 |
| 2021/0059898 | A1 | 3/2021 | Wersland et al. | |
| 2021/0113421 | A1 | 4/2021 | Chuang | |
| 2021/0128402 | A1* | 5/2021 | Dai | A61F 7/00 |
| 2021/0137779 | A1 | 5/2021 | Ayu et al. | |
| 2021/0196562 | A1 | 7/2021 | Zhao | |
| 2021/0244610 | A1 | 8/2021 | Wersland et al. | |
| 2021/0322257 | A1 | 10/2021 | Lee et al. | |
| 2021/0369549 | A1 | 12/2021 | Almodovar | |
| 2022/0096320 | A1 | 3/2022 | Lu | |
| 2022/0154764 | A1 | 5/2022 | Yamashita | |
| 2022/0168175 | A1 | 6/2022 | Tang | |
| 2022/0168177 | A1 | 6/2022 | Vierheller | |
| 2022/0211575 | A1 | 7/2022 | Wersland | |

FOREIGN PATENT DOCUMENTS

| | | | | |
|---|---|---|---|---|
| CN | 2694966 | Y | 4/2005 | |
| CN | 202536467 | U | 11/2012 | |
| CN | 205268525 | U | 6/2016 | |
| CN | 206381369 | U | 8/2017 | |
| CN | 208130157 | U | 11/2018 | |
| CN | 306178047 | | 11/2020 | |
| CN | 2020305792978 | | 3/2021 | |
| CN | 306489315 | | 4/2021 | |
| CN | 2021302494257 | | 8/2021 | |
| KR | 102249761 | B1 * | 4/2021 | A61H 15/00 |
| TW | M511855 | U | 11/2015 | |
| TW | M543692 | U | 6/2017 | |
| TW | D207405 | | 9/2020 | |
| WO | WO 2022/149067 | | 7/2022 | |

OTHER PUBLICATIONS

English translation for CH388531, espacenet.com, translated on Jul. 8, 2021.

English translation for CN 212749648 from Espacenet on Jul. 18, 2022 (year 2021).

Youtube,, "ShoDuo Absorption & Reverberation Massage Head", Published Date: Sep. 26, 2022. https://www.youtube.com/ watch?v=OW6z6eYNo4o (Year: 2022).

amazon.com; Massage Gun Massage Gun—Massage Pulse Mini Muscle Massage Gun; Apr. 28, 2022; 2 pgs.

AliExpress.com; Portable Massage Gun Deep Tissue Percussion Muscle Massager For Pain; retrieved on Nov. 22, 2022; 1 pg.

amazon.com; Mebak 3 Massage Gun Muscle Massager Electric Hand Massager, May 22, 2020; 3 pgs.

Flyby—Massage gun. Date: Aug. 11, 2020. [online]. [Site visited Dec. 1, 2022]. Available from Internet URL: www.youtube.com/ watch?v =GYvuNuif8Bc (Year: 2020).

Massage guns. (Design -@Questel) orbit.com. [Online PDF compilation of references selected by examiner] 50 pgs. Print Dates Range Apr. 28, 2020-Mar. 11, 2022 [Retrieved Dec. 2, 2022] https://www.orbit.com/export/UCZAH96B/pdf4/e6b9a3b3-195c-4fbe-87b2- 0eaaf315609e-165234.pdf (Year: 2022).

HP Race Development—Titanium connecting rods. Date: Apr. 30, 2021. [online]. [Site visited Dec. 15, 2022]. Available from Internet URL: https://www.hpracedevelopment.com/news/titanium-connecting-rods-now-available-all-current-250f-models#/ (Year: 2021).

Massage Gun Deep Tissue, Percussion Muscle Massager Gun for Athletes—Flyby F1 Pro—Handheld Neck & Back Massager for Pain Relief—Therapy and Relaxation Body Massager Gun—Lightweight (Black), [retrieved on Oct. 28, 2021], 9 pp., Retrieved from the Internet: https://www.amazon.com/massage-Gun-Deep-Tissue-Lightweight/dp/B07Y8SRYL3/ref=sr_1_1_sspa?crid=2WY18SO0AT230&dchild=1&keywords=flyby%2Bmassage%2Bgun&qid=1635265651&s=hpc&sprefix=Flyby%2B%2Chpc%2C179&sr=1-1-.

Weileite—Accumulator Piston Kit. Date: Aug. 24, 2021. [online] [Site visited Jan. 12, 2023]. Available from Internet URL: https:// www.amazon.com/dp/B09J15G8V7/ (Year: 2021).

Flyby Massage Gun Deep Tissue. Date: Dec. 30, 2019. [online]. [Site visited May 15, 2023]. Available from Internet URL: https:// www.amazon.com/dp/B07Y8SRYL3/?th=1 (Year: 2019).

Gladiour—Massage Gun Handheld Hammer. Date: Jan. 20, 2021 [online]. [Site visited May 15, 2023]. Available from Internet URL: https://www.amazon.com/dp/B08QJNVP6F/ (Year: 2021).

Toloco Massage Gun. Date: Jan. 7, 2020. [online]. [Site visited May 15, 2023]. Available from Internet URL: https://www.amazon.com/ dp/B083L8RNJR/?th=1 (Year: 2020).

Toloco Massage Gun, upgrade Percussion Musde Massage Gun tor Athletes, Handheld Deep Tissue Massager Black) , [retrieved on Oct. 29, 2021], 10 pp., Retrieved from the Internet: https://www.amazon.com/TOLOCO-massage-Gun-Upgraded-Brushless/dp/B083L8RNJR/ref=sr_1_1 sspa?dchild=1 &keywords=Massage%2Bgun&qid=1635272886&sr=8-1-ons&spLa=ZW5jcnlwdGVkUXVhbGlmaWVyPUFETDEwSENOVDg4SzgmZW5jcnlwdGVkSWQ9QTAyOTUzNTMxN.

* cited by examiner

TOP VIEW

PERCUSSION MASSAGER HAVING VARIABLE AND SELECTABLE STROKE LENGTH

CROSS-REFERENCE TO RELATED APPLICATIONS

The present application claims priority to the following U.S. Provisional Application Ser. No. 63/164,278 filed Mar. 22, 2021 and Ser. No. 63/120,502 filed Dec. 2, 2020, which are incorporated herein by reference in their entireties.

The following applications are incorporated herein by reference in their entireties: U.S. patent application Ser. No. 17/229,860 entitled Variable Stroke Percussive Massage Device, filed Apr. 13, 2021 and U.S. application Ser. No. 17/508,954 filed on Oct. 22, 2021 entitled Constrained and Repositionable Percussive Massage Device Tool and Tool Receiver, both commonly owned and listing overlapping inventors.

FIELD OF THE INVENTION

This invention relates to percussion massagers, and more specifically, to a variable stroke length percussive massage device configured as a handheld device that delivers a barrage of short rapid adjustable strokes that penetrate deeper into the muscle tissue.

BACKGROUND

Percussion massage devices have become increasing popular for home use. Typical percussion massage devices have a massage head that moves back and forth between an extended position and a retracted position. Typically, this distance can range from about 10 mm to about 20 mm and is referred to as the device's stroke length. This movement may occur as a rapid reciprocating motion, such as between about 1700 to about 3400 strokes per minute.

Conventional percussion massage devices have a fixed stroke length, albeit this fixed stroke length can vary from one device to another. Thus, if a user desires a gentler, shorter stroke length on another day, they typically need to own two different percussion massage devices.

Therefore, there is a need for a device that can provide a user percussive massage therapy while allowing a user to change the stroke length in a simple and quick manner. The present invention accomplishes these objectives.

SUMMARY OF THE INVENTION

In a first embodiment, a percussion massage device having a user selectable stroke length is described. The percussion massage device includes: a stroke arm having a first end connected to a piston at a first end thereof and the stroke arm having a second end secured to a crank pin, the piston further being connected at a second end thereof to at least a first end of a massage tool and the massage tool having a second end thereof for massaging a user; a crank mechanism including the crank pin, a crank housing and a crank base, wherein the crank housing and crank base are connected and rotatable as a single unit, and the crank pin is movably secured between the crank housing and crank base such that the crank pin moves from a first end to a second end of a sliding groove located in the cam housing when a rotation direction of the single unit is reversed by a motor; wherein when the crank pin is moved from the first end to the second end of the sliding groove, a stroke length of the piston is changed from a first predetermined stroke length to a second predetermined stroke length.

In a second embodiment, a percussion massage device having a user selectable stroke length is described. The percussion massage device includes: a massage tool for massaging a user in accordance with a percussive action supplied by a piston; a crank mechanism in mechanical communication with the piston, the crank mechanism including a crank pin, a crank housing and a crank base, wherein the crank housing and crank base are connected and rotatable as a single unit, and the crank pin is movably secured between the crank housing and crank base such that the crank pin moves from a first end to a second end of a sliding groove located in the cam housing when a rotation direction of the single unit is reversed by a motor; wherein when the crank pin is moved from the first end to the second end of the sliding groove, a stroke length of the piston is changed from a first predetermined stroke length to a second predetermined stroke length.

BRIEF DESCRIPTION OF THE DRAWINGS

Example embodiments will become more fully understood from the detailed description given herein below and the accompanying drawings, wherein like elements are represented by like reference characters, which are given by way of illustration only.

DETAILED DESCRIPTION

Figure 1:
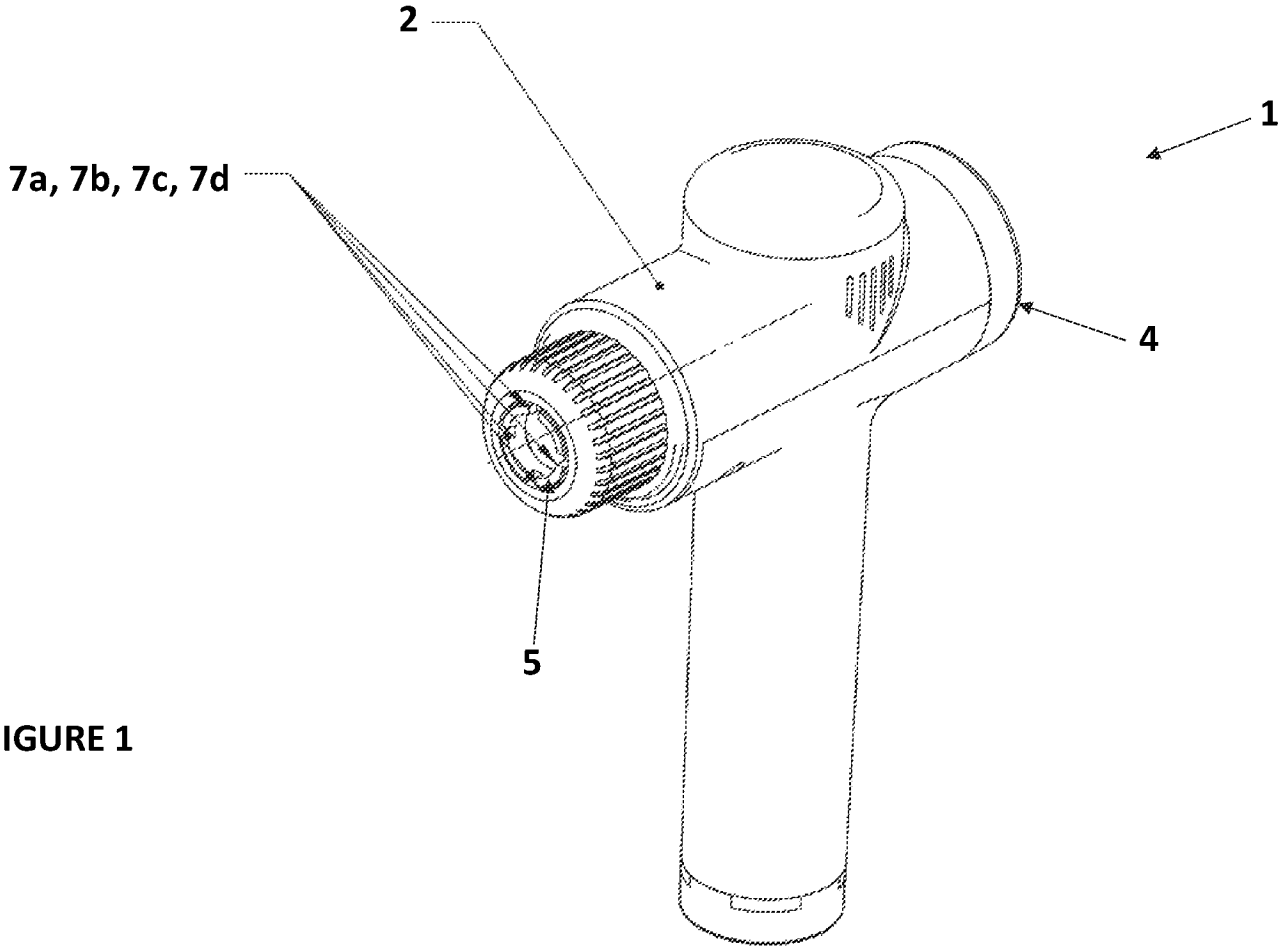
FIG. 1 is a perspective view of a representative percussion massage device which may incorporate the variable stroke length subsystem described herein.
Figure 2B:
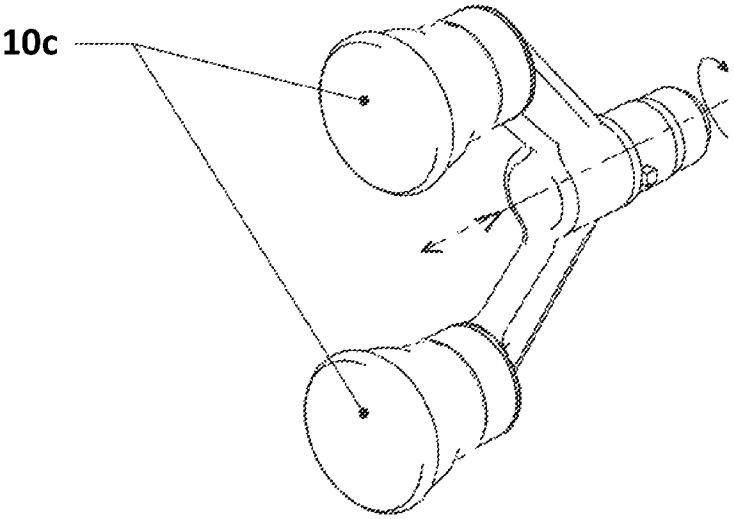
FIGS. 2*a*, 2*b*, 2*c* are exemplary tools which may be uses to deliver the percussion massage to the muscle of the user.
Figure 2A:
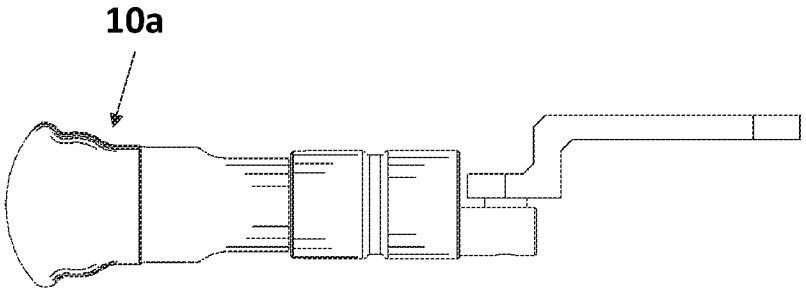
Figure 2C:
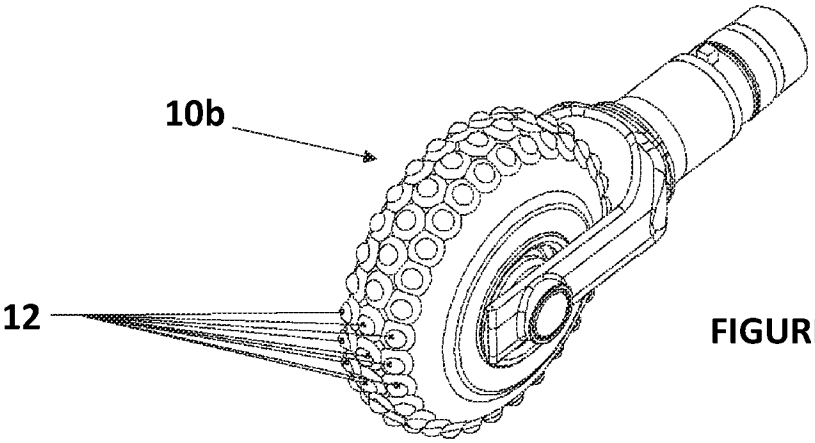

FIG. 1 illustrates an exemplary percussion massage device 1 which may incorporate the variable stroke length subsystem described further herein. The percussion massage device 1 of FIG. 1 receives a massage tool (not shown), which may be one of various configurations, in the tool holder 5 thereof. FIGS. 2*a*-2*c* shows examples of tools 10*a*, 10*b*, 10*c* which may be removably attached to tool holder 5 of FIG. 1 in accordance with a key and keyway (see key ways 7*a*, 7*b*, 7*c*, 7*d* in FIG. 1) attachment system and/or a magnetic attachment system, which are described in U.S. application Ser. No. 17/508,954 which is incorporated herein by reference in its entirety. The tools 10*a*, 10*b*, 10*c* deliver a barrage of short rapid adjustable strokes to the user's muscle tissue in accordance with the variable stroke length subsystem. The tread 12 of FIG. 2*c* is exemplary and may take on different configurations. Further, the tools may also include exchangeable massage tips, wherein the massage tips having varying shapes, sizes and materials, such that a user may select a massage tip that provides a preferred massage experience.

FIGS. 3*a*, 3*b*, 3*c*, 3*d* and 3*e* illustrate various views and features of an exemplary variable stroke length subsystem 20 in accordance with a preferred embodiment. As shown in top perspective view FIG. 3*a*, tool holder/slider 5 which is responsive to the reciprocation motion of piston 23 which is attached to a first end of a connecting rod 30 at ball bearing 27*a* and fastener/retainer (e.g., screw) 29*a*. A second end of connecting rod 30 is connected to a crank housing 35 at ball bearing 27*b* and fastener/retainer 29*b*. Crank housing 35 is attached to crank base 40 via multiple fasteners 29*c*. Motor 50, including motor base 45, drives the crank base 40, which also rotates crank housing 35, resulting in slidable movement of crank pin 41 (FIG. 4*b*) which is discussed in detail herein. The motor 50 is preferably a reversible direction motor. The piston 23 oscillates in the direction of travel ($D_T$) at, e.g., 5000 rpm, in accordance with the crank shaft mechanism described above. In certain embodiments, one skilled in art will appreciate that the tool holder/slider 5 may further include a sliding bearing and a vibration isolator. The vibration isolator may be a damper made of a low durometer elastomeric material working to absolve vibrations between the slider 5 and the device housing 2.

Figure 3A:
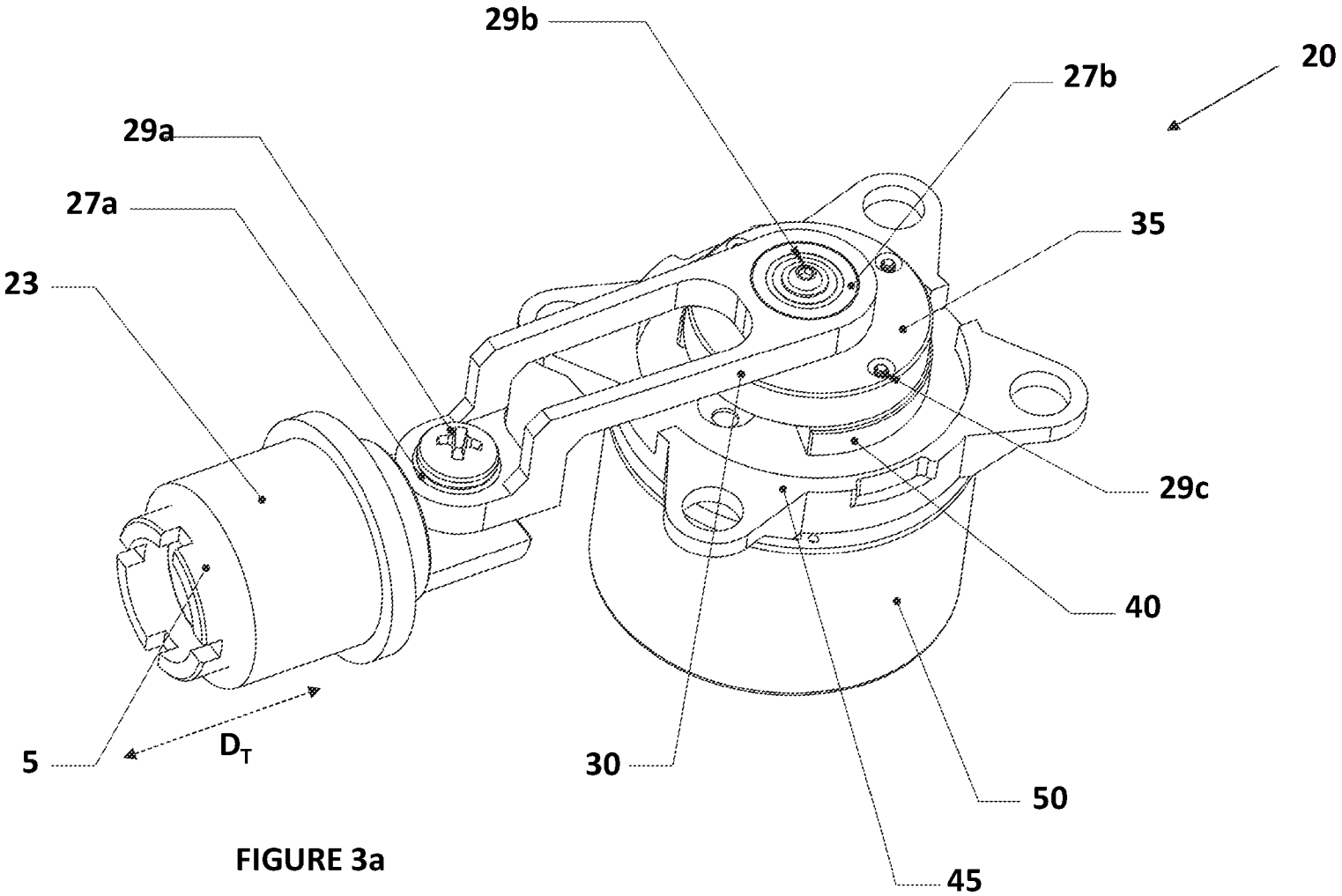
FIGS. 3*a*, 3*b*, 3*c*, 3*d*, 3*e* are various views of a variable stroke length subsystem in accordance with a preferred embodiment.
Figure 3B:
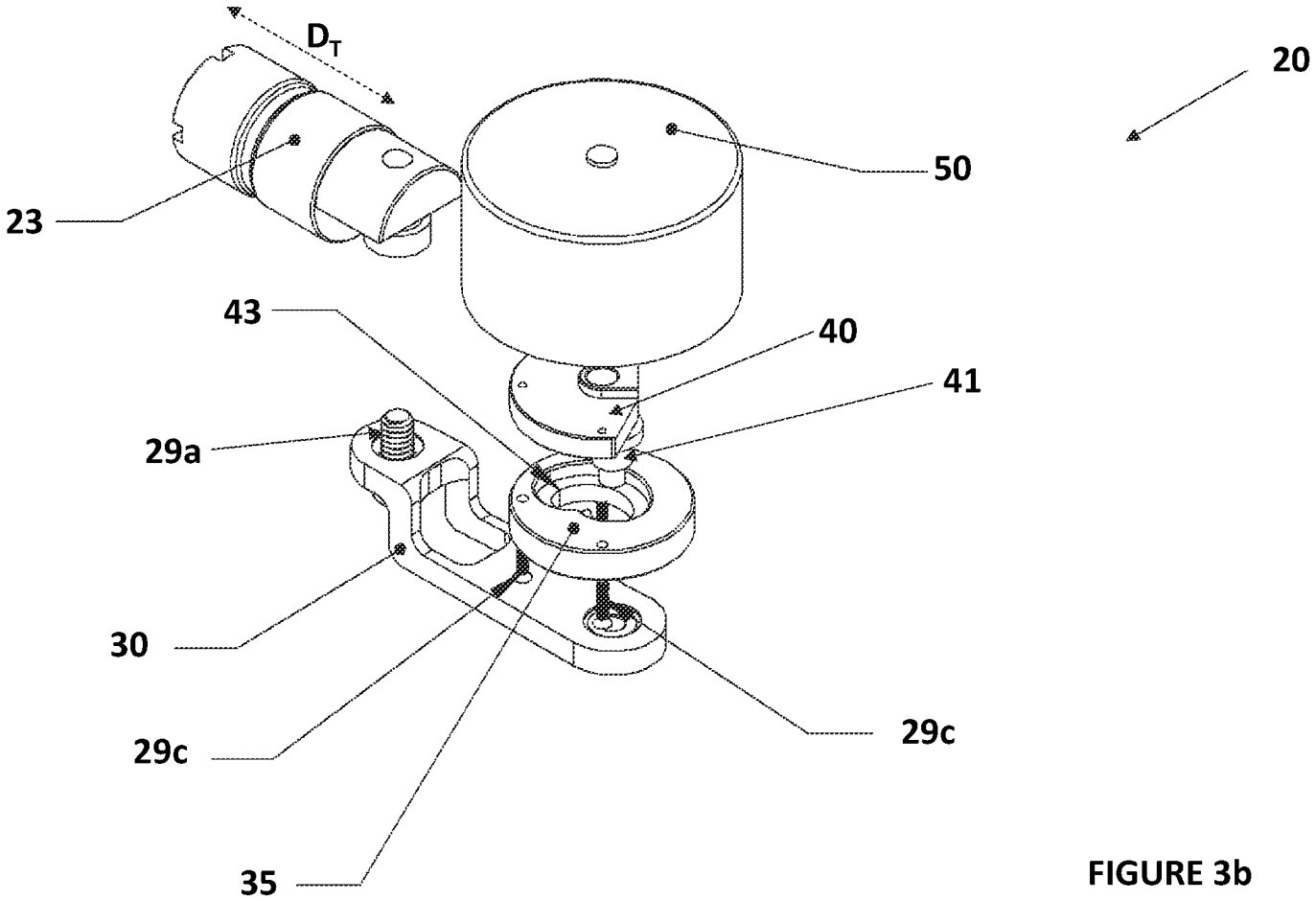

FIG. 3*b* is a bottom exploded perspective view of the exemplary variable stroke length subsystem 20. In this view, the opening or sliding groove 43 of the crank housing 35 can be seen. As discussed herein, crank pin 41 is slidably held and movable within the opening 43. In a preferred embodiment, the sliding groove has a non-linear shape, preferably an arc-shape, having a radius of curvature that is greater than a radius of curvature of the crank housing 35 and crank base 40, which rotate together as a single unit.

Figure 3C:
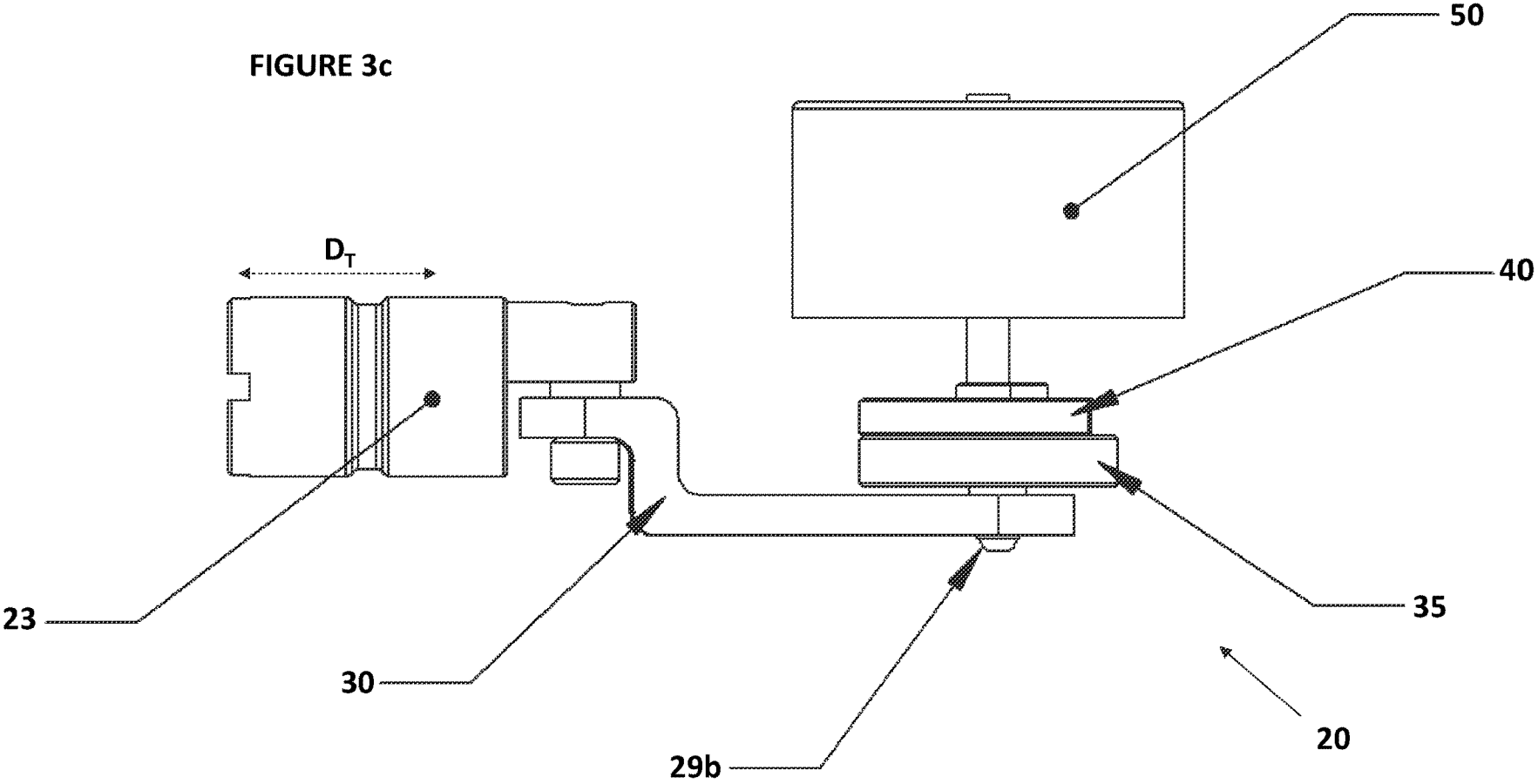
Figures 3D, 3E:
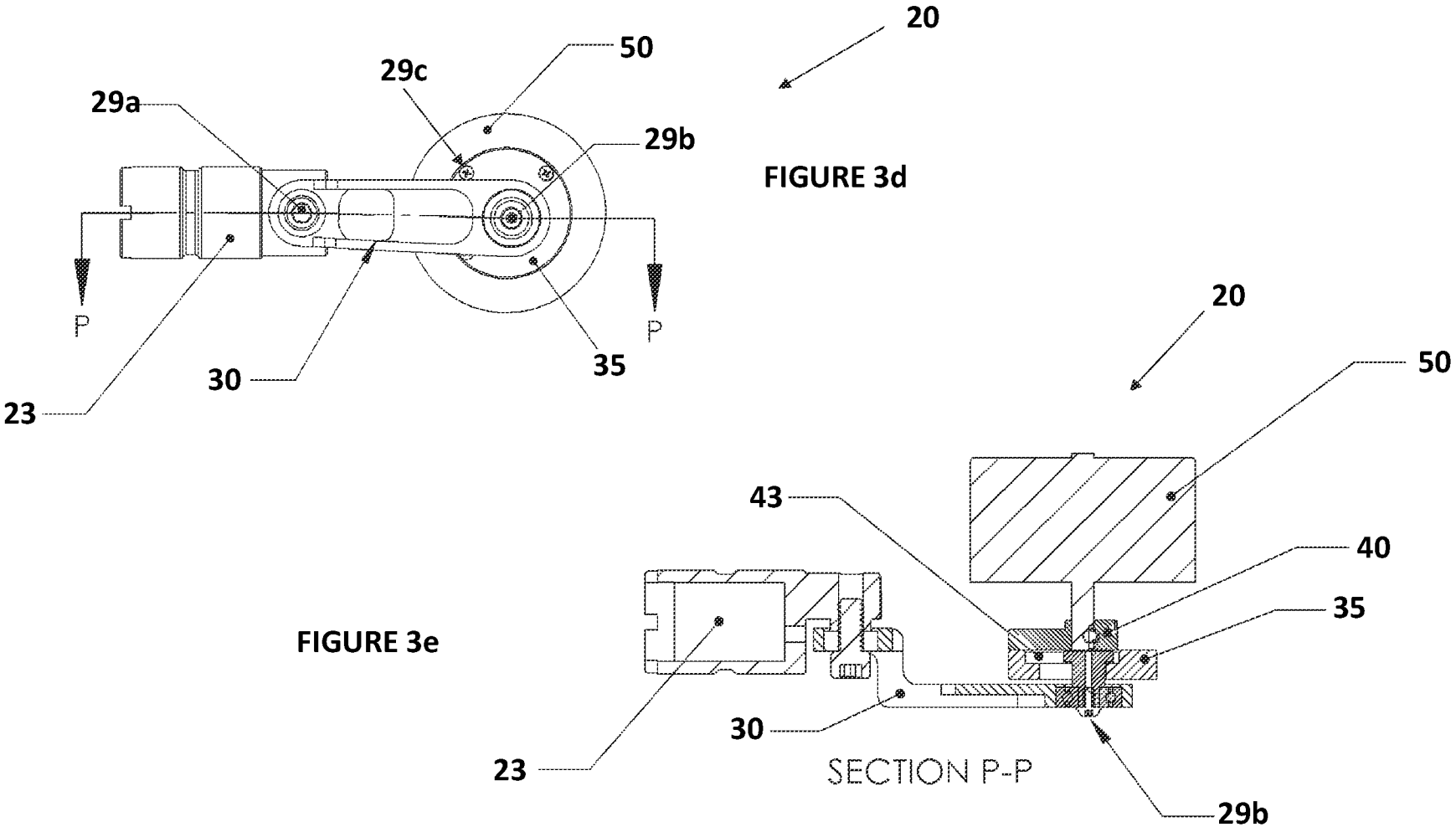

FIG. 3*c* is a side view of a variable stroke length subsystem 20 in accordance with a preferred embodiment. FIG. 3*d* is a top view of a variable stroke length subsystem 20 in accordance with a preferred embodiment, with FIG. 3*e* showing internal side view in accordance with section P-P.

Figure 4A:
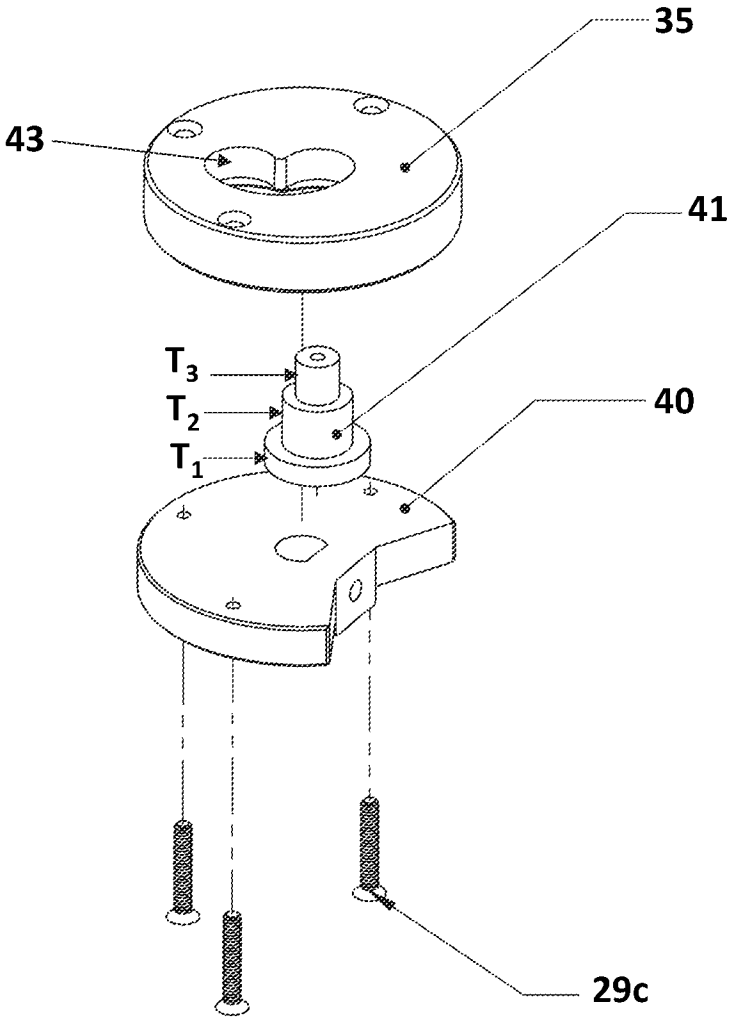
FIGS. 4*a*, 4*b*, 4*c*, 4*d*, 4*e* are various views of particular aspects of the variable stroke length subsystem of FIGS. 3*a*, 3*b*, 3*c*, 3*d*, 3*e*.

FIGS. 4*a*, 4*b*, 4*c*, 4*d*, 4*e* illustrate various views of crank housing 35, crank base 40, fasteners 29*c*, and crank pin 41 inserted into sliding groove 43. In FIG. 4*a*, the multi-tiered pin 41 configuration can be seen, wherein the bottom tier $T_1$ has the widest diameter, middle tier $T_2$ has a smaller diameter than tier $T_1$ and tier $T_3$ has the smallest diameter. Crank pin 41 is created with a hard material, such as, but not limited to aluminum.

Figure 4B:
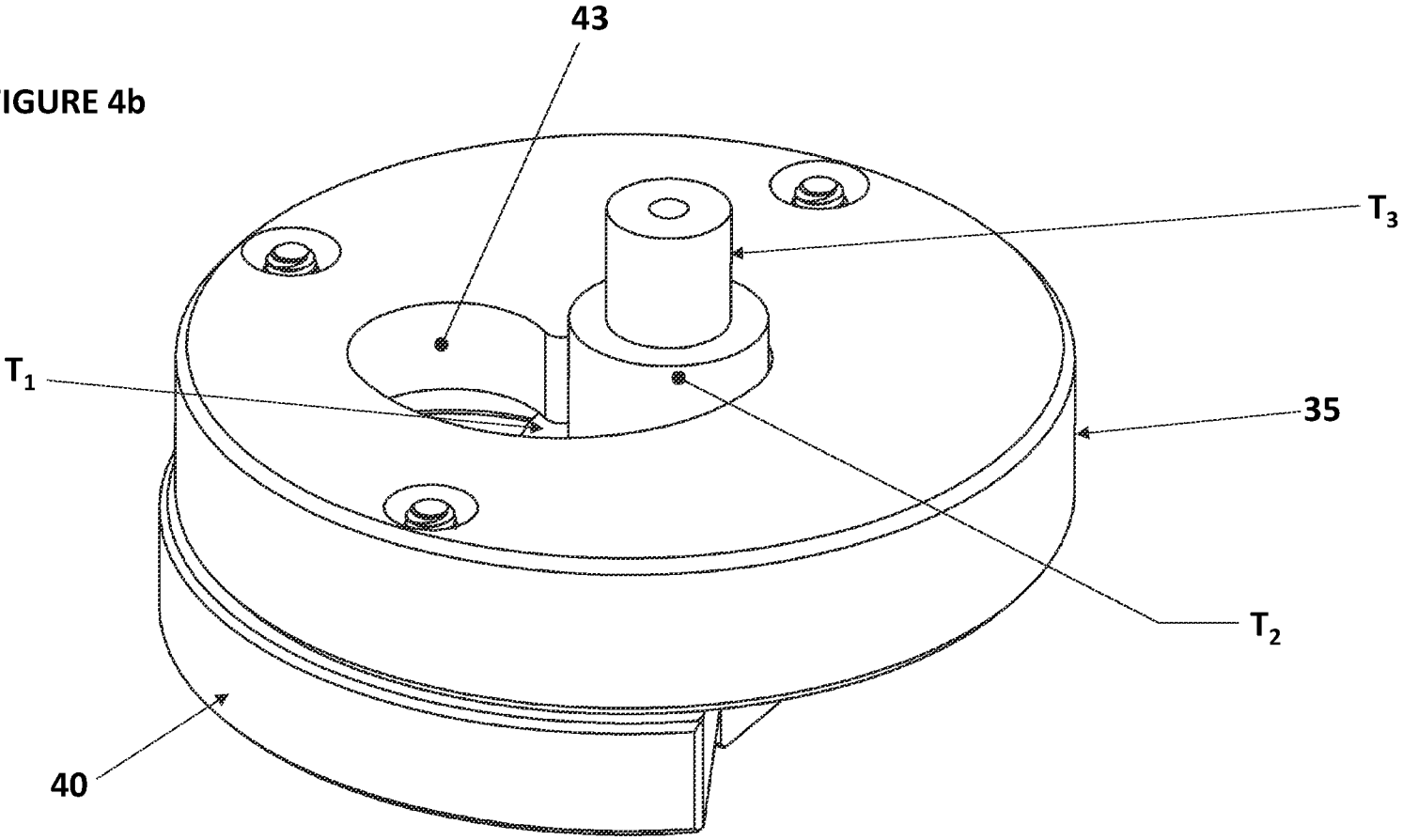

In FIG. 4*b*, an operational (unexploded) view of the crank pin 41 sandwiched between the crank housing 35 and crank base 40 is illustrated. As shown, tier $T_1$ of crank pin 41 sits below the sliding groove 43 which is narrower in width as compared to the diameter of $T_1$ and $T_2$ fits slidably within sliding groove 43. And $T_3$ protrudes out of crank housing 35 and is secured to connecting rod (not shown). The crank pin 41 will be sliding to the sliding groove 43 as a slip fit fitting.

Figure 4D:
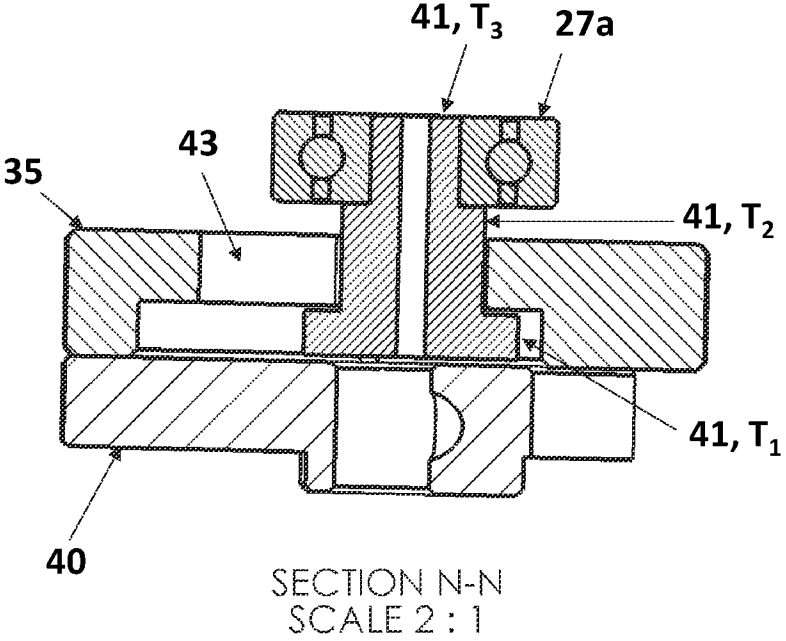
Figure 4C:
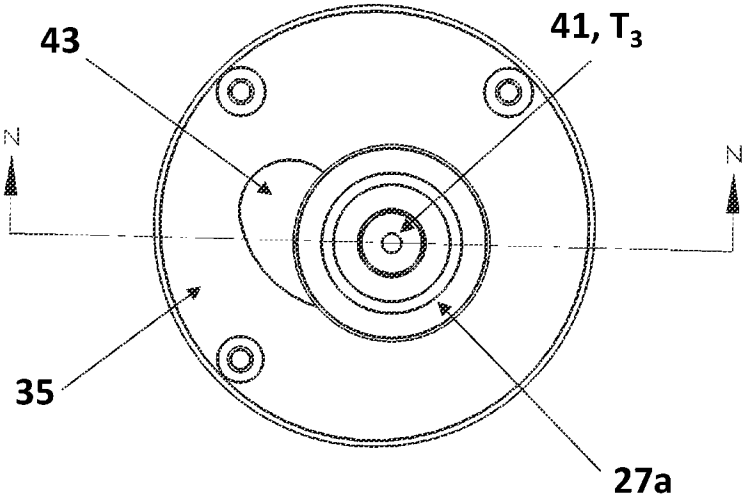

FIG. 4*c* is a top view of crank housing 35 with top of tier $T_3$ of crank pin 41 showing (without fastener 29*a*) and bearing 27*a* illustrated (without connecting rod). By excluding the connecting rod from the view, a portion of sliding groove 43 is also shown. FIG. 4*d* is the cross-sectional view.

Figure 4E:
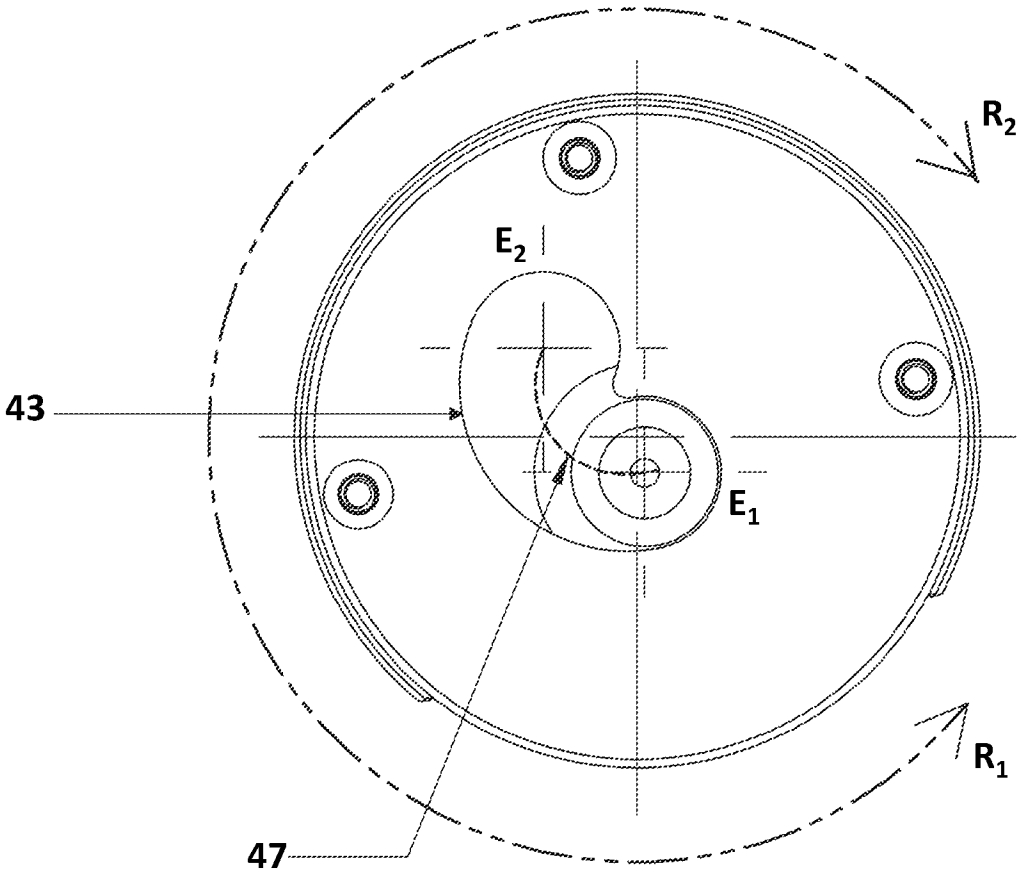

Referring to FIG. 4*e*, sliding groove 43 has two ends $E_1$ and $E_2$ which are located at different distances from the center of rotation of the crank housing. In operation, depending on the direction of rotation $R_1$ (counter clockwise) or $R_2$ (clockwise) of the crank housing 35 driven by motor 50 (not shown), crank pin 41 slides between the two ends of the sliding groove 43 along sliding trajectory 47, where the distance of travel is proportional to the radial distance to the groove from the axis to the connecting rod (FIG. 4*a*). If direction of rotation is $R_1$, the crank pin 41 engages with end $E_2$ which is further from the center of rotation; if direction of rotation is $R_2$, the crank pin 41 engages with end $E_1$ on the which is closer to the center of rotation.

In the preferred embodiment, $E_1$ engages crank pin 41 at center of rotation bottom end at 4 mm+/−2 and $E_2$ engages crank pin 41 at the center of rotation top end at 10 mm+/−2. These positions result in a variable stroke of 4 mm to 10 mm (short stroke) 10 mm to 22 mm (long stroke). A change in rotation direction of the crank base 40 causes crank housing 35 to change direction, which causes crank pin 41 to slide from one end of the sliding groove 43 to the other and consequently changes the variable stroke length of the piston 25.

Figure 5A:
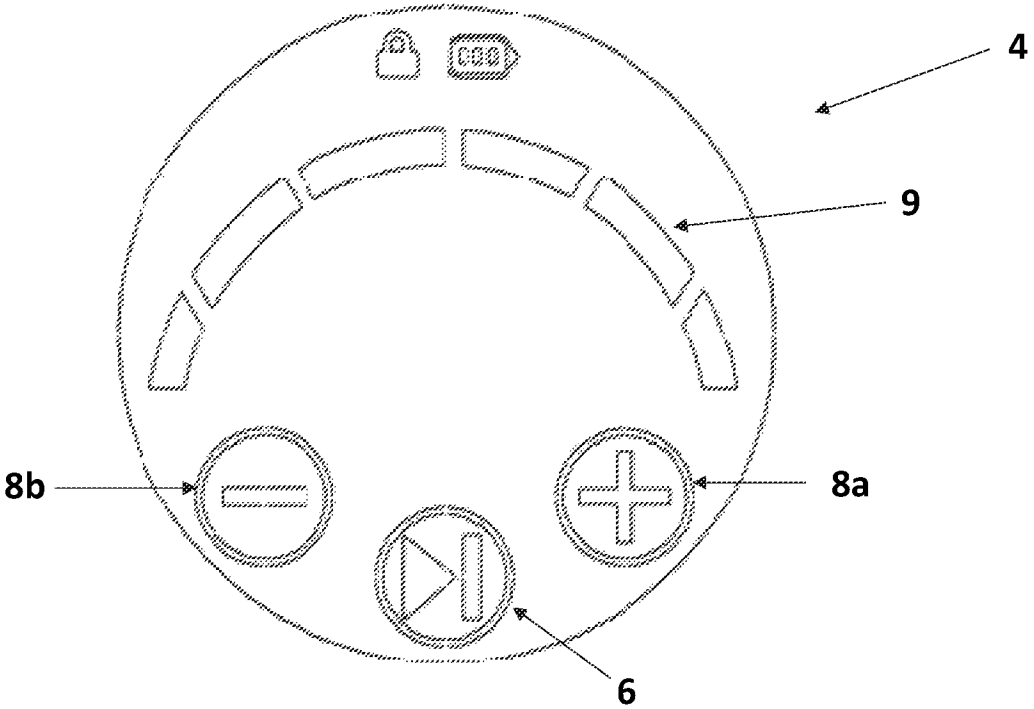
FIGS. 5*a*, 5*b*, 5*c* are exploded and partial internal views of a representative percussion massage device with various views of a device display in accordance with one or more embodiments.
Figure 5B:
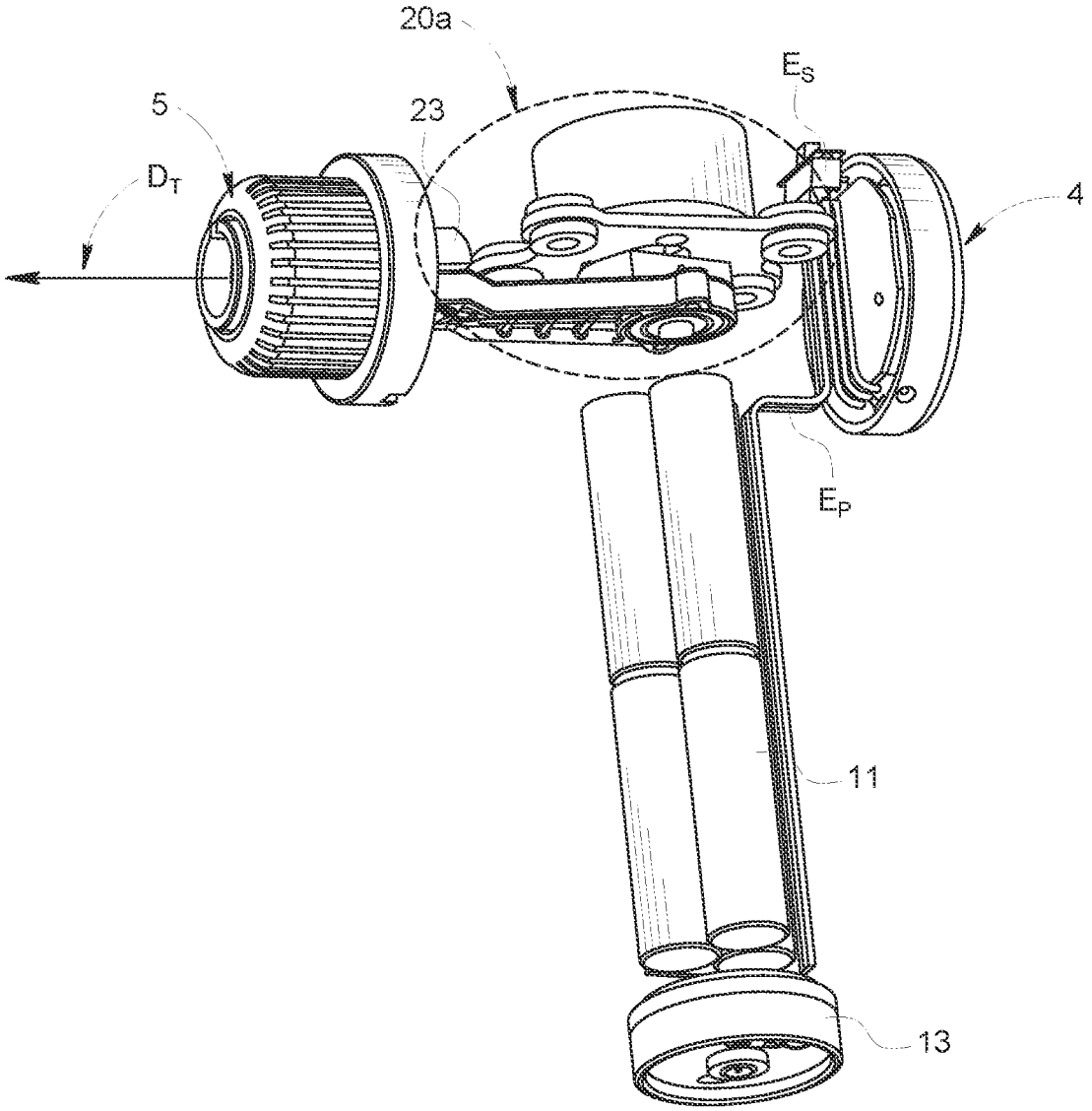
Figure 5C:
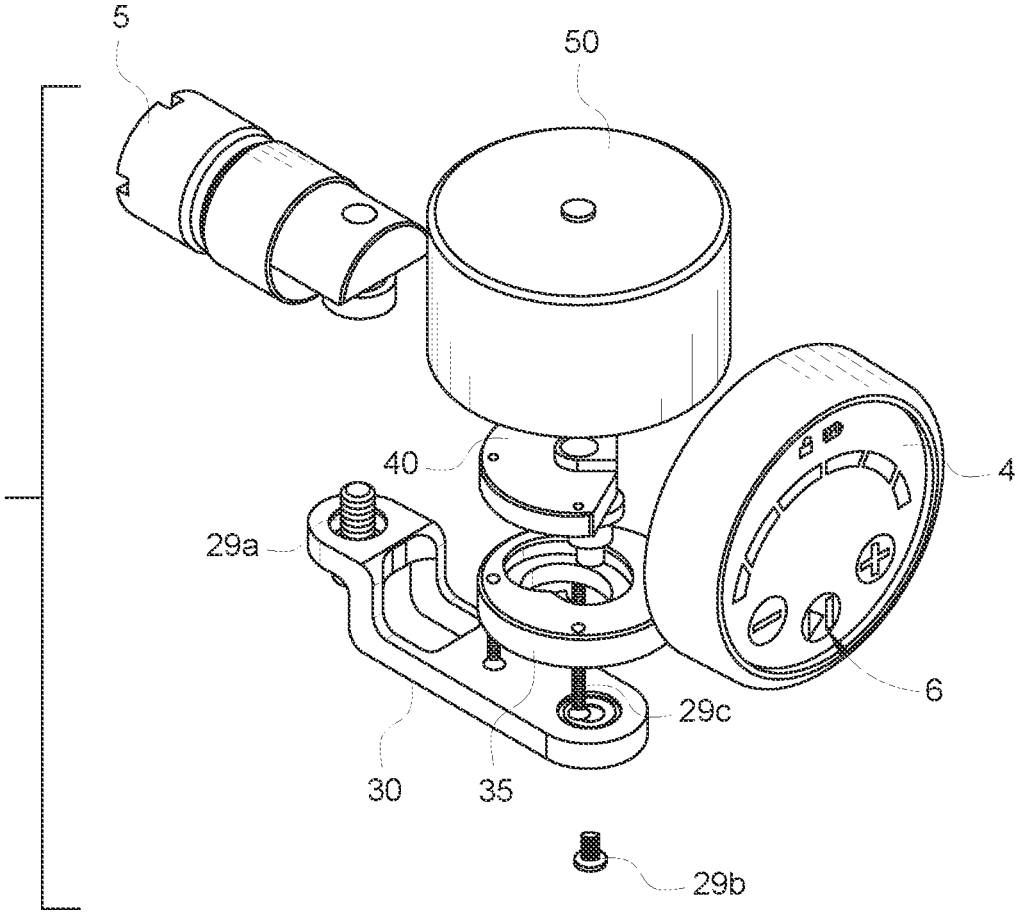

Referring to FIGS. 5*a* to 5*c*, a user may select a preferred stroke length from two available stroke lengths (short or long) using a tactile direction switch 6 provided on the display 4. For visual indication, the switch is illuminated and changes from a first to a second color depending on the selected stroke length. The user may also adjust speed of the stroke to a desired level using increase and decrease buttons 8*a*, 8*b*, with a visual indication of speed level indicated on the lighted display 9.

In FIG. 5*b*, internal electrical connections which power the display $E_P$ and facilitate the switching $E_S$ are illustrated, along with exemplary rechargeable battery component 11 and power base 13. The switching subsystem 20A of FIG. 5*b* is described in application Ser. No. 17/229,860 and may be replaced with switching subsystem 20B described herein above in detail and shown in relation to display 4 in FIG. 5*c*. Additional description of exemplary switch configurations and internal details which are usable with the embodiments described herein are disclosed in application Ser. No. 17/229,860 which is incorporated herein by reference.

The embodiment set forth above is exemplary. Unless otherwise defined, all technical and scientific terms used herein have the same meaning as commonly understood by one of ordinary skill in the art to which the embodiment belongs. The variable stroke percussive massage device may be embodied in other specific forms without departing from the spirit or essential attributes thereof, and it is therefore desired that the present embodiment be considered in all respects as illustrative and not restrictive.

The invention claimed is:

1. A percussion massage device having a user selectable stroke length, comprising:

a stroke arm having a first end connected to a piston at a first end of the piston and the stroke arm having a second end secured to a crank pin, the piston further being connected at a second end of the piston to at least a first end of a massage tool and the massage tool having a second end for massaging a user;

a crank mechanism including the crank pin, a crank housing and a crank base, wherein the crank housing and crank base are separate but connected with a space between the crank housing and the crank base, and rotatable as a single unit, and the crank pin is movably secured in the space between the crank housing and crank base, but not physically attached to the crank housing and the crank base, such that the crank pin moves independently from the single unit from a first end to a second end of a sliding groove located in the crank housing when a rotation direction of the single unit is reversed by a motor;

wherein when the crank pin is moved from the first end to the second end of the sliding groove, a stroke length of the piston is changed from a first predetermined stroke length to a second predetermined stroke length.

2. The percussion massage device having a user selectable stroke length of claim 1, wherein when the crank pin is at the first end of the sliding groove, the crank pin is in a first distance range from a rotation axis of the single unit and when the crank pin is at the second end of the sliding groove, the crank pin is in a second distance range from the rotation axis of the single unit.

3. The percussion massage device having a user selectable stroke length of claim 1, wherein the first distance range is about 2 mm to about 6 mm and the second distance range is from about 8 mm to about 12 mm, providing a first predetermined stroke length when in the first distance range from about 6 mm to about 10 mm when the pin is at the first end of the sliding groove and a second predetermined stroke length when in the second distance range from about 18 to about 22 mm when the pin is at the second end of the sliding groove.

4. The percussion massage device having a user selectable stroke length of claim 1, wherein the sliding groove is non-linear.

5. The percussion massage device having a user selectable stroke length of claim 4, wherein the sliding groove is arc-shaped, having a radius of curvature that is greater than a radius of curvature of the single unit during rotation of the single unit.

6. The percussion massage device having a user selectable stroke length of claim 1, wherein the crank pin includes three tiers.

7. The percussion massage device having a user selectable stroke length of claim 1, including a switch located on a display of the percussion massage device, wherein the switch enables selection by the user of the first or second predetermined stroke length range.

8. A percussion massage device having a user selectable stroke length, comprising:

a massage tool for massaging a user in accordance with a percussive action supplied by a piston;

a crank mechanism in mechanical communication with the piston, the crank mechanism including a crank pin, a crank housing and a crank base, wherein the crank housing and crank base are separate but connected with a space between the crank housing and the crank base and rotatable as a single unit, and the crank pin is movably secured in the space between the crank housing and crank base, but not physically attached to the crank housing and the crank base, such that the crank pin moves independently from the single unit from a first end to a second end of a sliding groove located in the crank housing when a rotation direction of the single unit is reversed by a motor;

wherein when the crank pin is moved from the first end to the second end of the sliding groove, a stroke length of the piston is changed from a first predetermined stroke length to a second predetermined stroke length.

9. The percussion massage device having a user selectable stroke length of claim 8, wherein when the crank pin is at the first end of the sliding groove, the crank pin is in a first distance range from a rotation axis of the single unit and when the crank pin is at the second end of the sliding groove, the crank pin is in a second distance range from the rotation axis of the single unit.

10. The percussion massage device having a user selectable stroke length of claim 8, wherein the first distance range is about 2 mm to about 6 mm and the second distance range is from about 8 mm to about 12 mm, providing a first predetermined stroke length when in the first distance range from about 6 mm to about 10 mm when the pin is at the first end of the sliding groove and a second predetermined stroke length when in the second distance range from about 18 to about 22 mm when the pin is at the second end of the sliding groove.

11. The percussion massage device having a user selectable stroke length of claim 8, wherein the sliding groove is non-linear.

12. The percussion massage device having a user selectable stroke length of claim 11, wherein the sliding groove is arc-shaped, having a radius of curvature that is greater than a radius of curvature of the single unit during rotation of the single unit.

13. The percussion massage device having a user selectable stroke length of claim 8, wherein the crank pin includes three tiers.

14. The percussion massage device having a user selectable stroke length of claim 8, including a switch located on a display of the percussion massage device, wherein the switch enables selection by the user of the first or second predetermined stroke length range.

* * * * *